United States Patent [19]

Lovell

[11] Patent Number: 4,644,766

[45] Date of Patent: Feb. 24, 1987

[54] NON-ELECTRONIC CARD-KEY ACTUATED COMBINATION LOCK

[75] Inventor: Walter C. Lovell, Wilbraham, Mass.

[73] Assignee: Avant Incorporated, W. Concord, Mass.

[21] Appl. No.: 538,980

[22] Filed: Oct. 4, 1983

[51] Int. Cl.[4] ..... E05B 47/00

[52] U.S. Cl. ..... 70/276; 70/354; 70/383; 70/384

[58] Field of Search ..... 70/137, 139, 287, 288, 70/210, 276, 312, 387, 382–385, 353–355; 292/30, 53, DIG. 37

[56] References Cited

U.S. PATENT DOCUMENTS

| | | | |
|---|---|---|---|
| 57,857 | 9/1866 | Burchell | 70/353 |
| 280,517 | 7/1883 | Roche | 70/354 |
| 1,084,502 | 1/1914 | Sullivan | 70/312 |
| 1,917,302 | 7/1933 | Hill | 70/384 |
| 2,067,319 | 1/1937 | Haag | 70/353 |
| 3,058,335 | 10/1962 | Cothron | 70/355 |
| 3,681,727 | 8/1972 | Hallmann | 70/276 |
| 3,837,193 | 9/1974 | Csurgay | 70/276 |
| 3,837,525 | 9/1974 | Kobayashi | 70/276 X |
| 3,978,700 | 9/1976 | Glass | 70/355 X |
| 4,114,410 | 9/1978 | Astier | 70/355 X |
| 4,133,142 | 1/1979 | Dzus, Jr. | 292/DIG. 37 |
| 4,409,806 | 10/1983 | Propst | 70/276 |

FOREIGN PATENT DOCUMENTS

| | | | |
|---|---|---|---|
| 58917 | 7/1941 | Denmark | 70/214 |

*Primary Examiner*—Gary L. Smith
*Assistant Examiner*—Lloyd A. Gall
*Attorney, Agent, or Firm*—Robert L. Nathans

[57] ABSTRACT

A first set of pivoted latching fingers having hook ends facing in a first direction are provided, together with a second set of pivoted latching fingers interlaced with the first set in accordance with a particular combination which unlocks the device. The fingers of the second set of latching fingers have hook ends facing in a direction opposite to the direction of orientation of the hook ends of the first set and actuation of only the proper combination of fingers causes the hooks of all fingers to be displaced away from a pair of facing lock anchor members to unlock the lock. All of the fingers are pivoted so that slight amounts of magnetically permeable material in the card key are sufficient to move the hooks of the pivoted latching fingers bearing permanent magnets, through a substantial distance, to enable the use of a thin, flexible card key for positive lock actuation. Additionally, slidable elongated hook protrusions may be selectively positioned to extend from the fingers in first or second directions, to enable changing the lock combination in a matter of seconds by inserting a new key card into the lock after all of such protrusions assume a first position with respect to all fingers.

24 Claims, 7 Drawing Figures

NON-ELECTRONIC CARD-KEY ACTUATED COMBINATION LOCK

BACKGROUND OF THE INVENTION

The present invention relates to the field of card-key code responsive locks.

Electronic security locks requiring specific card keys to open them are presently in use in connection with hotels, motels, apartment entrances, industrial areas and the like having doors requiring access by authorized personnel. A "card-key" for actuating the locking devices often comprises a thin plastic card which may be readily stored in the users wallet, typically having iron oxide strips laminated therein, which bear a binary access code for actuating the locks.

Many of these systems are electronic, in that electronic circuits are employed to sense the code formed upon the magnetic strip, amplify the sensed code, and actuate the lock after the proper code is recognized by electronic comparison circuitry. These systems generally require electrical wiring to supply power, and also must be maintained, since electrical circuitry is subjected to malfunctioning. For example, relay contacts become oxidized, and integrated circuits fail, to create such a malfunction.

It is thus an object of the present invention to provide a non-electronic, inexpensive, reliable card-key activated combination lock alternative to electric combination locks, in order to eliminate maintenance problems and downtime due to malfunction, together with the need for electrical wiring which is a nuisance, or other communication links, such as radio channels.

It is a further object of the invention to provide a lock which is primarily mechanical in nature and may be readily actuated by a coded plastic card, not requiring prior art coded "BUMPS" and which is thin enough to be carried in the users wallet, and yet is not permanently magnetized, which would cause the card to mutilate or erase codes formed upon iron oxide strips in other cards carried by the user.

It is a further object of the present invention to provide a locking device which, in contrast with conventional mechanical key locks, do not require tumblers of various sizes, so that the mechanical elements responsive to a given combination code may all be identical to each other, thereby to reduce manufacturing costs, and inventory control problems. In contrast with the prior art, it is desirable to provide a mechanical lock which may be actuated by a thin card key positioned very close to the mechanical latching elements, thereby to minimize the amount of metallic material to be laminated within the plastic card key so that it is thin and flexible. Although the movements of the magnetic portion of the latching elements are quite small in the present invention, due to the closeness of positioning of the card therewith, this movement may be mechanically amplified so as to readily unlatch the latching elements from associated anchor members, thereby to reduce potential manufacturing tolerance problems with respect to the size and placement of the components. Since the card-key code sensing ends of the latching fingers of the present invention are widely separated from the latching ends of the fingers which interact with the anchor members, the proper material may be readily used in connection with the fabrication of each end of the latching element i.e., magnetic material to be positioned at one end of the latching element is generally not suitable for repeated latching with the anchor members due to wear factors.

In U.S. Pat. Nos. RE: 27,753 and 3,271,988 a card key actuates the locking tumblers directly, but requires a substantial movement to unlock the device, to in turn require a substantial magnet or metallic insert within the card, of considerable mass, which is highly unsatisfactory and impracticable since the card key should be thin and light.

U.S. Pat. No. 3,271,953 teaches the use of a card key having a covered metallic sheet punched out in areas that require the magnet lock pins to maintain a separated position when the card key is inserted. This design depends upon the magnetic tumbler pins being held apart from the stationary magnetic pins by means of providing pins polarized with the like poles that repel. When a metallic sheet is placed between these magnetized pins, the repelling force is directed in such a manner as to cause the repelled pin to be attracted to the stationary pin, releasing the sliding lock plate. Thick metallic inserts must be used in the card key designed to alter the repelling forces, because the distance between the locking pins must be great enough to accommodate the locking plates. In contrast, the locks of the present invention do not utilize the principle of dual opposing magnets with like polarities, because the magnet ends of the latch fingers are positioned very close to the card key and can thus be sufficiently attracted to a very thin, low mass, metallic insert within the key to cause the latching finger to be moved through the small distance required to actuate the lock. Additionally, in contrast with prior art teachings, the present invention does not require the physical sliding of a lock plate as in designs of the prior art, and thus a card key may be employed having a relatively slight amount of metallic inserts. Amplification of the relatively small motion of the latching members adjacent the card key results in the latching or unlatching of the lock with ease.

SUMMARY OF EMBODIMENTS OF THE INVENTION

In accordance with one embodiment of the present invention, a first set of pivoted latching fingers having hook ends facing in a first direction is provided, together with a second set of pivoted latching fingers interlaced with the first set in accordance with a particular combination which unlocks the device. The fingers of the second set of latching fingers have hook ends facing in a direction opposite to the direction of orientation of the hook ends of the first set, and actuation of only the proper combination of fingers causes the hooks of all fingers to be displaced away from the lock anchor members to unlock the lock. More specifically, if one or more fingers of the first finger set are not actuated, so that all of the fingers which are supposed to be actuated in accordance with the proper combination are not actuated, the hook of such finger(s) will remain engaged with a first anchor member and the lock will not open. On the other hand should one or more fingers of the second set be actuated, contrary to the proper combination, the oppositely facing hook portions thereof, which are normally disengaged from a second anchor member will become engaged with such second anchor member, to prevent the lock from opening. The hook ends are formed at terminal portions of the longer finger portions of the pivoted fingers, whereas permanent magnets are preferably affixed to the short finger portions of the fingers, which are on the opposite side of the finger pivot point relative to the long finger portions of the fingers.

The plastic card key has the proper combination of spots of highly magnetically permeable material which causes all of the short legs of the first set of fingers to be attracted to the spots, to in turn pivot the entire first set of fingers to enable the release of the lock. Since the ratio of the length of the long finger portions over the length of the short finger portions is greater than unity, the hooks will move a relatively large distance away from the locking anchor members to effect the unambiguous unlatched conditon, without potential manufacturing tolerance problems. In contrast, due to this lever configuration, movement of short leg portions will be through a shorter distance, which means that the plastic key card may be positioned very close to the permanent magnets to thus enable the use of slight amounts of suitable material in the key card to attract the magnets to actuate the fingers. Should this distance be greater, the mass of the material required would be much greater, and the card key would be too thick for wallet storage.

In accordance with another feature of the invention, hooks preferably comprising slidable elongated protrusions may be selectively positioned to extend from the fingers in first or second directions, to enable changing the lock combination in a matter of seconds by inserting a new key card into the lock after all of such protrusions assume a first position with respect to all fingers.

BRIEF DESCRIPTION OF THE DRAWINGS

Other objects, features and advantages of the present invention will become apparant upon study of the following more specific description taken in conjunction with the drawings in which.

DETAILED DESCRIPTION

Figure 1:
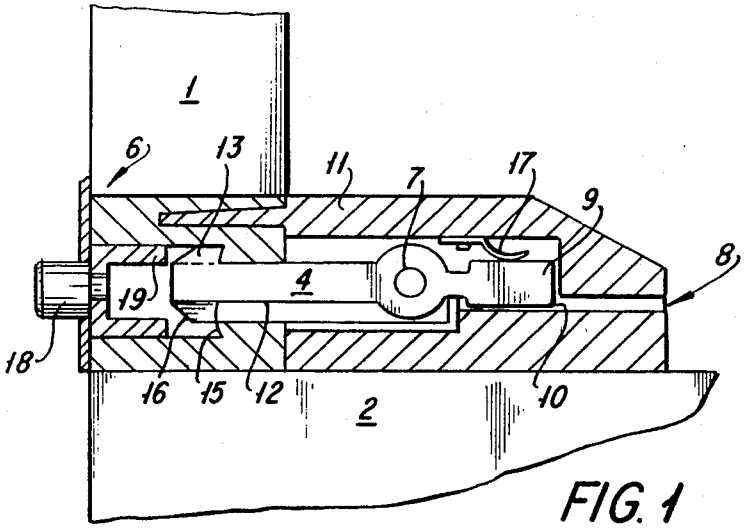
FIGS. 1–3 disclose various embodiments of the present invention.

In FIG. 1 a first embodiment of the invention is illustrated, wherein a door 1 is positioned adjacent its frame 2. Frame portion 6 includes a bank of elongated latching fingers 4 which are pivotably mounted upon pivot pin 7. A key card insert slot 8 is configured to receive a key card so that the code actuating portion of the card will be positioned adjacent the short finger portion 9 of finger 4. At the terminal portion of the longer finger portion, a hook member is formed upon the finger which engages anchor member 11, rigidly affixed to door 1. The lock preferably includes a plurality of pivoted latching fingers which are actuated in the manner of the keys of a piano, and if the proper combination of fingers is actuated, all of the hook portions will clear the anchor member 11 and the door may thus be opened.

Now let it be assumed that a key card is inserted within slot 8 which has the proper combination of "bumps" or raised actuating portions. Certain of the latching fingers will be actuated, and their hook ends 13 will clear the shoulders of anchor member 11. These latching fingers comprise a first set having their hooks facing upwardly as indicated by hook 13. Other latching fingers which should be actuated in accordance with the proper combination, will also have their corresponding upwardly facing hook members moved downwardly due to the interaction between the card bumps and the short finger portion 9. However, should one or more of the latching fingers which should not be actuated become actuated, their downwardly facing hook members such as 16 (affixed to a latching member behind the member in the plane of the drawing) will become engaged with the shoulder of the lower anchor member, 15 to prevent the lock from opening.

Thus in accordance with the illustrated embodiment of the invention, a first set of latching fingers having hook members extending upwardly, is interleaved with a second set of latching fingers having their hook ends extending in a direction 180° opposite to the direction of orientation of the hook members of the first set. Thus the improper actuation of a latching finger will cause its downwardly extending hook member such as 16 to be downwardly displaced to maintain the latched condition, and furthermore the insertion of a tool into slot 8 to indiscriminately actuate fingers, will cause an actuated finger having a downwardly facing hook 16 to engage the lower anchor member to prevent the lock from opening. The insertion of the card having the proper placement of "bumps", will cause all hook members of all pivoted latching fingers to clear the shoulders of both the upper anchor member and the lower anchor member and door 1 may be opened. A leaf spring 17 is advantageously provided to mechanically bias the shorter finger portion downwardly.

The door preferably has a conventional door knob, so that when all of the hooks have cleared the anchor means, the owner of the inserted card-key presses against the door knob (or the door if there is no knob) to enable door 1 to be displaced to the left in FIG. 1. When the card-key holder has entered the premises he closes the door to cause the hook ends to again actuate the lock by being locked into the anchor means (at 15), just after the hooks assume neutral positions as the door is being closed, due to the tapered portions 13 and 16 contacting the right hand portion of member 6. When the card-key holder wishes to leave the locked premises, he actuates button 18 to in turn displace slide member 19 to the right to cause the hook ends to again assume the neutral position, enabling the holder to pull the door knob, or a projection upon the door if there is no knob, which will enable the door with the anchor members to clear the neutrally positioned hook ends. Finger support member 10 maintains the proper positioning of finger portion 9 within slot 8.

Figure 2:
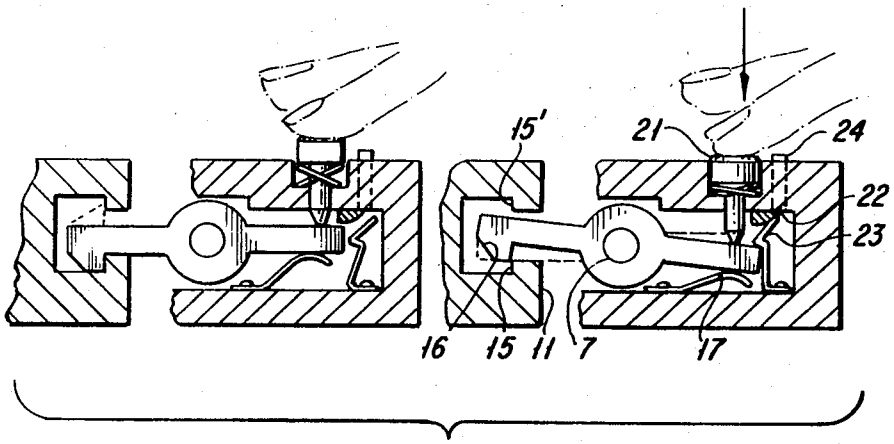

In FIG. 2, a second embodiment of the invention is illustrated whereby push button finger actuating means 21 may be actuated to cause clockwise pivoting of the latching finger about pivot member 7 to in turn cause hook member 16 to clear the shoulder 15 of anchor member 11. The push button operates against the counter pressure of leaf spring 17. As before, the improper actuation of a single latching finger having an upwardly facing hook member rather than a hook member oriented as illustrated, will cause such normally disengaged hook member to engage the upper shoulder 15', of anchor 11. A holding latch finger spring 22 is illustrated which will maintain actuated fingers in the downward direction due to the ledge 23 formed therein. If an improper combination is actuated, a lock reset bar 24 is pushed to cause the upper portion of latching spring 22 to be displayed to the right, thereby to enable the counter clockwise rotation of the latching finger under the influence of spring 17. This arrangement eliminates the requirement that the fingers of the operator remain positioned against the buttons up until the time of opening the door.

Figure 3:
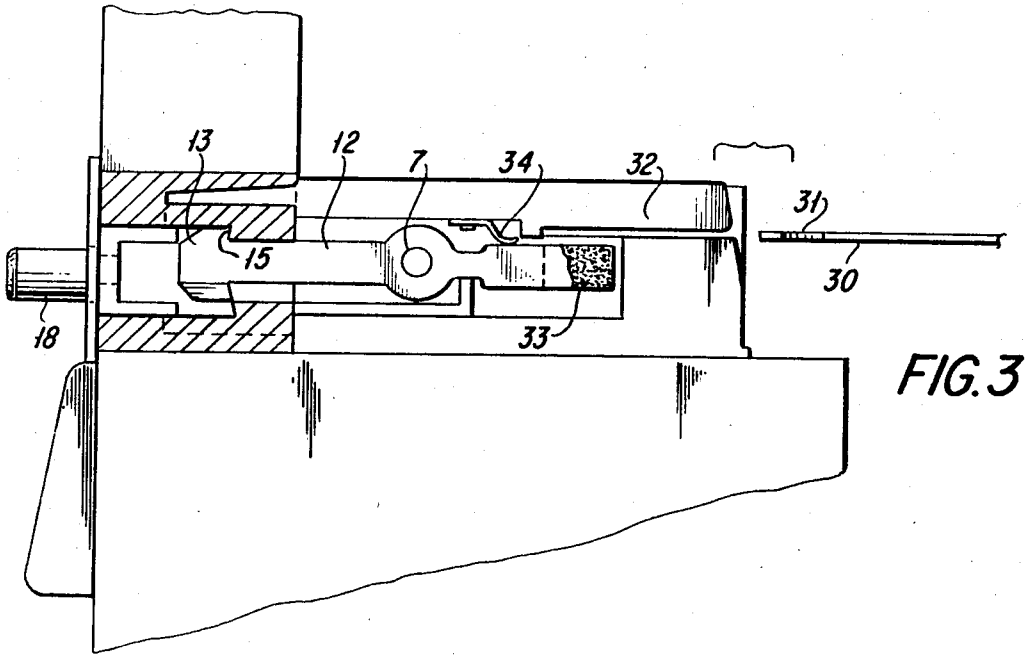

In FIG. 3, a currently preferred magnetically actuated embodiment of the invention is illustrated, having certain components corresponding to those described in FIG. 1. A card key 309 which could of course also comprise an identification card, has a plurality of ferromagnetic inserts formed across the width of the card at selected positions, which manifests the combination of the lock. It is an important aspect of this embodiment of the invention that the magnetic material in the card not be permanently magnetized to produce large quantities of flux, because a card key having permanent magnets therein could erase magnetically recorded data in other credit cards or the like in the users wallet.

Slot 32 is configured to receive the key card 30 positioned so that the spots of magnetic material 31 will become aligned with permanent magnets 33 which are affixed to the short finger portions. It is an important aspect of this embodiment of the present invention, that the magnetic material 31 be positioned very close to the short leg of the latching finger so that the relatively slight mass of material formed within the thin card is able to cause counter clockwise rotation of the latching fingers through a small angle. If larger displacements of the finger portions would be required, as in the prior art, the resulting air gap and magnetic reluctance would be great, and a far greater amount of magnetic material would have to be formed in the key card, which is impractical since such cards would have considerable thickness.

It is a further important aspect of the invention that the finger portions bearing the hook members preferably be relatively long, or at least longer than the portions bearing the magnets, so that displacement of the hook members is through a magnified distance relative to the relatively small displacement of the magnet portions of the fingers, thereby to reduce possible manufacturing tolerance problems mentioned earlier. Also the separation of the magnetic material at one terminal portion of the finger from the hook member material at the other is significant, since the hook member should have different metallurgical characteristics than the magnet portions.

Let it be assumed that the latching finger having the downwardly extending hook 16 should not be actuated and upwardly extending hook 13 should be actuated. In this case a magnetic spot would be positioned on the card aligned with the finger in the plane of the drawing and counter clockwise rotation of the latching finger would cause hook member 13 to be released from the upper anchor member whereas a "no spot" condition at the adjacent finger would maintain the hook member 16 of the second finger in the disengaged position as shown in the drawing. Should a magnetic spot be present however, counter clockwise rotation of the second latching finger would cause normally disengaged hook 16 to engage the lower portion of the anchor member and the lock would not open.

Thus in summary, all of the fingers of a first finger set to be actuated in accordance with a proper combination must be actuated, and if any fingers are actuated in the second set of fingers interleaved with the first set, the normally disengaged hook members such as 16 will become engaged, thereby to inhibit the opening of the lock. As before, the lock is opened from the inside by actuating button 18, to cause the pivotable latching fingers to move toward each other to in turn maintain the hook members in the disengaged position with respect to the anchor members.

Figures 4, 5, 6, 7:
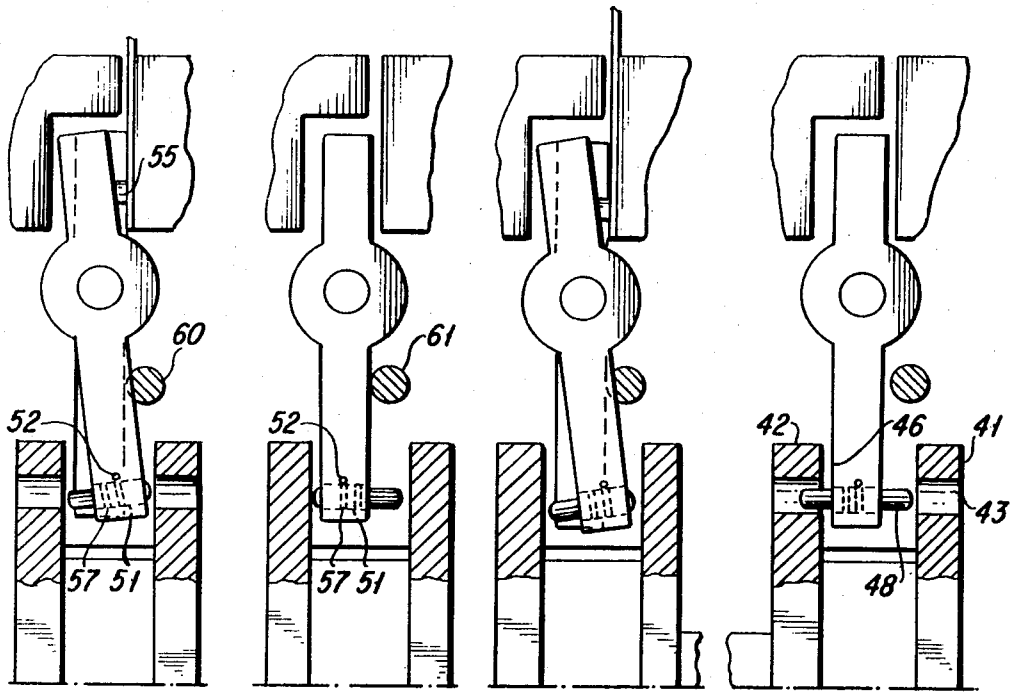
FIGS. 4–7 disclose a mechanism for rapidly changing the combination of the lock.

In the embodiments illustrated so far, the combination of these lock mechanisms cannot be readily changed without disassembly of the lock mechanism. Accordingly, the inventor has designed a resetable combination lock whereby the directions of orientation of the hook member may be selectively reversed in accordance with a new combination in a matter of seconds, and such a lock will be described in connection with FIGS. 4 through 7, which additionally illustrate the use of the invention in connection with a rotary disk which could be coupled to a door knob. Rotary disk portions 41 and 42 illustrated in FIG. 4, may be mechanically coupled to a door knob, not shown. These disks have straight elongated slots 43 and 44 formed therein for receiving the hook members which comprise elongated slidable rods rather than those hook members shaped as disclosed in the preceding figures. In FIG. 4, the latching finger comprises a rod member 48 which is slidably positioned within the terminal portion of the pivoted latching finger. The lock will be opened by causing counter clockwise rotation of the proper first set of latching fingers which have their elongated hook members 46 positioned within the slot formed in the left hand disk 42 as illustrated. All of the proper latching fingers must be actuated to cause hook members 46 to clear the slot. As before, the actuation of one or more improper latching fingers of the second set, interlaced with the first set, will cause the normally disengaged elongated rod members 48 to be positioned within slot 43 of disk 41 to inhibit the rotation of the door knob coupled to rotary disk 41.

FIG. 5 illustrates the position of the latching fingers when the key card is inserted into the slot which has the proper combination to unlock the lock. The elongated hook members would preferably have a groove 51 formed therein which is positioned against a detent member such as spring element 52, thereby to lock the relative position of the rod relative to the terminal portion of the pivoted finger. A second groove member 57 is formed within the pin for receiving the detent number 52 when the relative position of the rod with respect to the finger is changed. In FIG. 6, the groove 51 is again illustrated together with second groove 57 for enabling the seating of the detent spring 52 within the second groove 57 rather than the first groove 51 upon the shifting of the relative position of the rod with respect to the terminal portion of the finger.

The combination of the lock is readily changed by inserting a key pin 61 into aperture 60 shown in FIG. 5. This action causes the clockwise rotation of all of the latching fingers and, due to the positioning of the left hand rotary disc affixed to the now turned door knob, all of the elongated hook members will be shifted as shown in FIG. 6, so that they point to the right, whereby detent spring 52 is seated within the left hand groove 57 of the pins. The pin 61 key is now removed and the new card key bearing the new combination is inserted into the slot to cause the actuation of a new first set of fingers in the counter clockwise direction. This action causes those fingers which are rotated counter clockwise to have the relative positions of the pin members shifted to the left due to the reaction forces of the inside surface of the right-hand disc against the pins. Those fingers which are not actuated in accordance with the new combination, will have their elongated pins remain in the right hand position. Upon removable of the new card key, the lock is now set in accordance with the new combination as shown in FIG. 4.

As a result of this mechanism, disassembly of the fingers is not required, and the combination of the lock may be readily changed in a few seconds for the sake of convenience and to further effect savings in labor costs and downtime. The above described mechanisms could also be employed in connection with the hook members shaped in accordance with FIGS. 1 through 3 and suitable detent members may be designed by those skilled in the art wherein the hooks could be for example rotated 180 degrees angularly, rather than providing pins which are displaced by translation. The use of a straight slot formed in the rotary discs affixed to the door knob maintains the previously described design wherein the latching fingers are aligned in a convenient straight line configuration, rather than being positioned angularly.

The term "anchor means" is to be construed as any element of any configuration coacting with the latching fingers to inhibit or enable opening of the lock. The term "fingers" is intended to cover any elements which perform functions similar to those described, and is not to be limited to thin elongated elements shown in the drawings. For example they could comprise L-shaped strips or wires which are translated rather than rotated between latched and unlatched conditions.

While particular embodiments of the present invention have been shown and described, it is apparent that various changes and modifications may be made, and it is therefore intended that the following claims cover all such modifications and changes as may fall within the true spirit and scope of this invention.

I claim:

1. In a combination locking device:

first and second anchor means;

first and second sets of latching fingers having hooks thereon and finger actuating portions;

pivot support means for pivotably supporting said first set of latching fingers about a single longitudinal support axis for causing the hooks thereof to extend from said fingers soley in a first direction toward said first anchor means to enable said hooks to interact with said first anchor means and for pivotably supporting said second set of latching fingers, interlaced with said first set about said single longitudinal support axis, for causing the hooks thereof to extend soley in a second direction different from said first direction toward said second anchor means to enable said hooks to interact with said second anchor means;

finger actuating means for actuating all of the fingers of said first set and none of the fingers of said second set in order to open said lock; and means for positioning a card-key closely adjacent said finger actuating portions of said latching fingers, said finger actuating portions having magnets coupled thereto and said card-key having highly magnetically permeable material positioned at selected portions thereof closely adjacent said magnets for attracting said magnets.

2. In a combination locking device:

first and second anchor means;

first and second sets of latching fingers having hooks thereon and finger actuating portions;

pivot support means for pivotably supporting said first set of latching fingers for causing the hooks thereof to extend from said fingers in a first direction toward said first anchor means to enable said hooks to interact therewith and for pivotably supporting said second set of latching fingers interlaced with said first set for causing the hooks thereof to extend in a second direction, toward said second anchor means to enable said hooks to interact therewith, the ratio of the distance between said hooks and said pivot support means over the distance between said finger actuating portions and said pivot means being greater than unity;

finger actuating means for actuating all of the fingers of said first set and none of the fingers of said second set in order to open said lock; and means for selectively adjusting the position of said hooks to cause major portions thereof to extend from either one side portion of said fingers or an opposite side portion thereof, thereby to readily change the combination of said lock.

3. The locking device as set forth in claim 2 wherein said hooks comprise slidable elongated protrusions, together with detent members for positively seating said protrusions in a first or second position with respect to said fingers.

4. The locking device as set forth in claim 2 or 3 including means for positioning a card key closely adjacent said finger actuating portions of said fingers.

5. In a combination locking device:

first and second anchor means;

first and second sets of latching fingers having hooks thereon;

means for movably supporting said first set of latching fingers for causing the hooks thereof to extend from said fingers in first direction toward said first anchor means to enable said hooks to interact therewith and for movably supporting said second set of latching fingers for causing the hooks thereof to extend in a second direction, toward said second anchor means to enable said hooks to interact therewith and for causing said second set of fingers to be interlaced with respect to said first set;

finger actuating means for actuating all of the fingers of said first set and none of the fingers of said second set in order to open said lock; and means for selectively adjusting the position of said hooks to cause major portions thereof to extend from either one side of said fingers or an opposite side thereof, thereby to enable changing the combination of said lock.

6. The locking device as set forth in claim 5 wherein said hooks comprise slidable elongated protrusions, together with detent members for holding said protrusions in a first or second position with respect to said fingers.

7. The locking device as set forth in claim 5 or 6 wherein said fingers are configured to cause said hooks to be positioned further from said means for supporting relative to the distance of said actuating means from said means for supporting.

8. In a combination locking device:

first and second anchor means facing each other;

pivot means for rotatably supporting a plurality of latching fingers having hooks thereon for engaging either said first or second anchor means upon the rotation of said latching fingers, some of said hooks pointing toward said first anchor means and some of said hooks pointing toward said second anchor means, and wherein said hooks comprise elongated members slidably mounted upon said fingers, selectively movable between a first and second position relative to said latching fingers in a manner to engage said first or said second anchor means, thereby to provide for the rapid resetting of the combination of said lock without disassembly thereof; and latching finger actuating means for causing all of said hooks to clear said first and second anchor means, provided that the proper combination of said fingers, but not all of said fingers, are rotated, thereby to release said lock.

9. The locking device as set forth in claim 8 further including detent means for positively seating said elongated members in said first or second position.

10. The locking device as set forth in claim 9 further including means for positioning all of said hooks in a first position by rotating said fingers in one direction, thereby to enable the resetting of said lock.

11. In a combination locking device:

first and second anchor means facing each other;

means for movably supporting a plurality of latching fingers having hooks thereon for engaging either said first or said second anchor means, said hooks comprising elongated member slidably mounted upon said fingers, some of said hooks pointing toward said first anchor means, and some of said hooks pointing toward said second anchor means, and wherein said hooks are selectively movable between a first and second position relative to said latching fingers in a manner to engage said first or said second anchor means, thereby to provide for the rapid resetting of the combination of said lock without disassembly thereof; and latching finger actuating means for causing all of said hooks to clear said first and second anchor means, provided that the proper combination of said fingers, but not all of said fingers, are actuated, thereby to release said lock.

12. The locking device as set forth in claim 11 further including detent means for positively seating said elongated members in said first or second position.

13. The locking device as set forth in claim 12 further including means for positioning all of said hooks in said first position, thereby to enable the resetting of said lock.

14. In a combination locking device:

first and second anchor means;

first and second sets of substantially identical pivotable latching fingers having hooks at first portions thereof and permanent magnets at second finger actuating portions thereof widely separated from said first portions;

pivot means intermediate said first and second finger portions for pivotably supporting said first set of latching fingers about a single longitudinal support axis for causing the hooks thereof to extend from said fingers soley in a first direction toward said first anchor means to enable said hooks to interact therewith and for pivotably supporting said second set of latching fingers interlaced wit said first set about said single longitudinal support axis for causing the hooks thereof to extend soley in a second direction opposite said first direction toward said second anchor means to enable said hooks to interact therewith;

mechanical biasing means for biasing said first set of fingers in a biasing direction to cause the hooks thereof to be engaged with said first anchor means and for biasing said second set of fingers in a biasing direction to cause the hooks thereof to be disengaged from said second anchor means; and finger actuating means for actuating all of the fingers of said first set and none of the fingers of said second set in order to open said lock.

15. The locking device as set forth in claim 14 wherein the ratio of the distance between said hooks and said pivot means over the distance between said magnet portions and said pivot means is greater than unity.

16. The locking device as set forth in claim 15 wherein said actuating means is configured to support a thin card-key including highly magnetically permeable material selectively positioned thereon closely adjacent said permanent magnets of said latching fingers for attracting said magnets.

17. The locking device as set forth in claim 14, 15, or 16 wherein said first and second anchor means comprises a cutout formed within a rotatable disc.

18. The locking device as set forth in claim 14, 15, or 16 further including means for selectively adjusting the position of said hooks to cause major portions thereof to extend from either one side portion of the terminal portions of said fingers or an opposite side portion thereof, thereby to enable changing the combination of said lock.

19. The locking device as set forth in claim 18 wherein said hooks comprise slidable elongated protrusions, together with detent means for holding said protrusions in a first or second position with respect to said fingers.

20. In a combination locking device:

first and second anchor means facing each other;

first and second sets of pivotable latching fingers having hooks at first portions thereof and magnets at second finger actuating portions thereof widely separated from said first portions;

pivot means intermediate said first and second finger portions for pivotably supporting said first set of latching fingers about a single longitudinal support axis for causing the hooks thereof to extend from said fingers soley in a first direction toward said first anchor means to enable said hooks to interact therewith, and for pivotably supporting said second set of latching fingers interlaced with said first set of latching fingers about said single longitudinal support axis for causing the hooks thereof to extend soley in a second direction substantially opposite to said first direction toward said second anchor means to enable said hooks to interact therewith;

mechanical biasing means for biasing said first set of fingers in a biasing direction to cause the hooks thereof to engage said first anchor means and for biasing said second set of fingers in a biasing direction to cause the hooks thereof to be disengaged from said second anchor means; and finger actuating means for actuating all of the fingers of said first set and none of the fingers of said second set, in order to open said lock.

21. The locking device as set forth in claim 20 wherein the ratio of the distance between said hooks and said pivot means over the distance between said magnet portions and said pivot means is greater than unity.

22. The locking device as set forth in claim 20 or 21 wherein said actuating means is configured to support a thin card-key including highly magnetically permeable material selectively positioned thereon closely adjacent said magnets fof said latching fingers for attracting some of said magnets but not all of said magnets.

23. The locking device as set forth in claim 20 or 21 wherein said hooks comprise slidable elongated protrusions, together with detent means for holding said protrusions in a first or second position with respect to said fingers.

24. The locking device as set forth in claim 20 or 21 wherein each said anchor means comprises a cutout formed within a rotatable disc.

* * * * *